US005282319A

United States Patent [19]

Casquilho et al.

[11] Patent Number: 5,282,319

[45] Date of Patent: Feb. 1, 1994

[54] BOTTOM DUMP BASKET FOR VEGETABLE SPIN DRYER

[75] Inventors: Manny R. Casquilho; Alan B. Heinzen, both of Gilroy; Edwin W. Mabie, Capitola; Ralph S. Schneider, Salinas, all of Calif.

[73] Assignee: Heinzen Manufacturing, Inc., Gilroy, Calif.

[21] Appl. No.: 857,759

[22] Filed: Mar. 26, 1992

[51] Int. Cl.[5] ..... F26B 5/08

[52] U.S. Cl. ..... 34/8; 34/58

[58] Field of Search ..... 34/8, 58, 56, 184, 236, 34/133 G; 99/495, 511, 513; 68/210; 210/367; 494/56

[56] References Cited

U.S. PATENT DOCUMENTS

| | | | |
|---|---|---|---|
| 3,570,135 | 3/1971 | Rousselet | 34/58 |
| 3,688,906 | 9/1972 | Ferrara | 34/58 |
| 4,461,096 | 7/1984 | Suzuki | 34/58 |
| 4,493,156 | 1/1985 | Siegmann | 34/58 |
| 5,027,530 | 7/1991 | Vollmer et al. | 34/58 |
| 5,054,209 | 10/1991 | Koff | 34/58 |

OTHER PUBLICATIONS

"Centrifugal Food Drying" brochure from Bock Engineered Products, Inc.; 1 sheet folded, both sides.

"Gimco's Food Processing Centrifuge" brochure from Gabilan Iron & Machine Company; 1 sheet, both sides.

*Primary Examiner*—Henry A. Bennet

*Assistant Examiner*—Denise Gromada

*Attorney, Agent, or Firm*—Robert Charles Hill

[57] ABSTRACT

A spindrying apparatus for removing retained rinse water from leafy product such as lettuce, cabbage, broccoli and spinach which includes a basket of wire mesh or perforated metal and a trapdoor in its floor. A liftbar extends across the top of the basket with a centrally located hole for attachment to the chain of a conveyor hoist providing that the basket may be filled with leafy product at a loading station then conveyed to a spindryer tank where it is lowered onto the rotatable platform within the tank. The platform and basket are spun to force the rinse water out of the leafy product. The chain is reattached and the basket is conveyed to an unloading station. A latch mechanism in the bottom of the basket is operated to release a trap door forming the floor of the basket thereby allowing the trapdoor to fall open and the leafy product to fall out of the basket. The trapdoor is then manually snapped shut and the basket is ready for the next drying cycle.

19 Claims, 3 Drawing Sheets

BOTTOM DUMP BASKET FOR VEGETABLE SPIN DRYER

BACKGROUND

1. Field of the Invention

This invention relates to spin dryers and particularly to a spindryer for drying a large quantity of leafy vegetables having a new and improved bottom dump basket.

2. Prior Art and Information Disclosure Statement

An important step in preparing for market large quantities of fruits or vegetables is to thoroughly wash the product in order to remove all traces of dirt and insecticides. After washing, the vegetables must be dried since water that is left on the surfaces of the vegetables provide the environment for bacteria to grow and spoil the product. Leafy vegetables such as lettuce, cabbage and spinach are especially susceptible to spoilage if not adequately dried. These products are much more difficult to dry than products such as apples, peaches or pears because of the larger irregular surface area per unit volume of the leafy vegetable where water can be trapped.

In order to more effectively dry leafy vegetable product, spin dryers have been disclosed. Bock Inc. manufactures dryer systems (model FP 90) which include a basket into which the produce is loaded at a loading station. A yoke straddling the top of the basket has a pair of arms that are detachably secured to a pair of lugs attached to the side of the basket so that the chain of a conveyor hoist can be attached to the yoke and transport the basket from the loading station to the spin dryer. The spin dryer includes a container with a top entrance. The basket is lowered into the container and positioned on a platform mounted on the vertical shaft of a motor drive located beneath the container. The yoke is then detached from the basket and lifted away from the spin dryer. A lid is closed on the top entrance and the motor drive is activated to spin the basket. Water from the surface of the vegetable product is thereby forced to pass through the mesh basket and eventually collect in the bottom of the dryer. After the spin drying step has been completed, the lid is reopened and the yoke is reattached to the lugs on the side of the basket. The basket is lifted out of the dryer and transported by the conveyor hoist to an unloading area. The basket is then manually tipped in order to empty the contents out of the open top. This is accomplished by rotating the basket supported at the lugs while still attached to the yoke. The empty basket is next carried by the conveyor system back to the loading station.

Gimco, Inc., Salinas, Calif. manufactures a spindryer that also employs a yoke for lifting the basket similar to Bock.

A problem with the Bock and Gimco systems is that the dryers must have a larger diameter than the basket in order that the basket with lugs will fit into the dryer. Detachment then reattachment of the yoke to the dryer is an awkward procedure when the basket is in the dryer. Tipping the basket in order to empty the basket is also an awkward operation. Injuries have resulted to operators as a result of this unsafe operation. The exertion by the operator required to tip the basket manually depends not only on the weight of the product but distribution of the product in the basket when the basket is supported by lugs at the side of the basket.

Vibration of the spindryer as the basket is rotated is also a problem and, in dryers of the prior art, the product must be evenly distributed to avoid excessive vibration. The Bock construction uses a "gyroscopic" basket mounting in which the end of the vertical drive shaft extends up into a deep recess in the center of the bottom of the basket with the object of having the center of gravity of the basket and its contents coincide with the point of support at the upper end of the drive shaft. This design tends to interfere with ease of emptying the contents of the basket when the basket is tipped. The Bock design also uses a counterweighted basket for self-balancing operation. This additional feature adds to the expense of the unit. The Gimco spindryer has a basket lid that engages the top end of the basket and spins with the basket.

THE INVENTION

Objects

It is an object of this invention to provide an apparatus and system for drying leafy vegetables after they have been thoroughly rinsed in water.

Another object is to provide a vegetable spin dryer with a bottom dump basket having a trapdoor in its floor.

Another object is that the design of the apparatus be amenable to handling large quantities of vegetables.

Another object is that transportation from loading to drying to unloading station be accomplished with greater convenience and safety than is provided by apparatus of the prior art.

Another object is that loading and unloading the containers of the apparatus be accomplished with greater ease and safety than is provided by the containers of the prior art.

Another object is that the spindryer of this invention minimize uneven distribution of product during spinning.

Another object is that the apparatus be less expensive to operate than apparatus of the prior art.

Summary

This invention is directed toward a spindryer for leafy vegetables which includes a cylindrical basket of wire mesh or perforated metal, a trap door forming its bottom and a lift bar across its top. The lift bar is provided with a lift hole which may be engaged with the hook on the end of a chain extending from a conveyor hoist thereby providing that the basket can be transported from a loading station to a spindryer tank. The basket is lowered into the tank onto a rotatable platform whence it is disconnected from the chain.

A tank lid hingably attached to the top rim of the tank is closed. A basket lid is rotationally mounted onto the underside of the tank lid so that when the tank lid is closed, the basket lid is simultaneously positioned on top of the basket. This arrangement secures the top end of the axis of rotation when the basket is spinning and thereby eliminates torque generated by unbalanced spinning product on the drive shaft engaged with the rotatable platform supporting the basket. The basket and its contents are now ready for spin drying.

During the spinning cycle, the lift bar breaks up clumps of leafy product. This action is most effective when the vertical width of the bar is in a range between three to eight inches.

After the spin drying step, the hook is reconnected to the bar and the basket is lifted out of the spindryer tank whence it is transferred to the unloading station. A catch on the trap door is released allowing the trap door to open so that the contents of the basket fall out. Next, the trap door is snapped shut and the basket is transported by the conveyor hoist back to the load station.

DRAWINGS

DESCRIPTION OF THE BEST MODE

The following paragraphs present various embodiments of the invention including what is presently believed to be the best mode for carrying out the invention.

Figure 1:
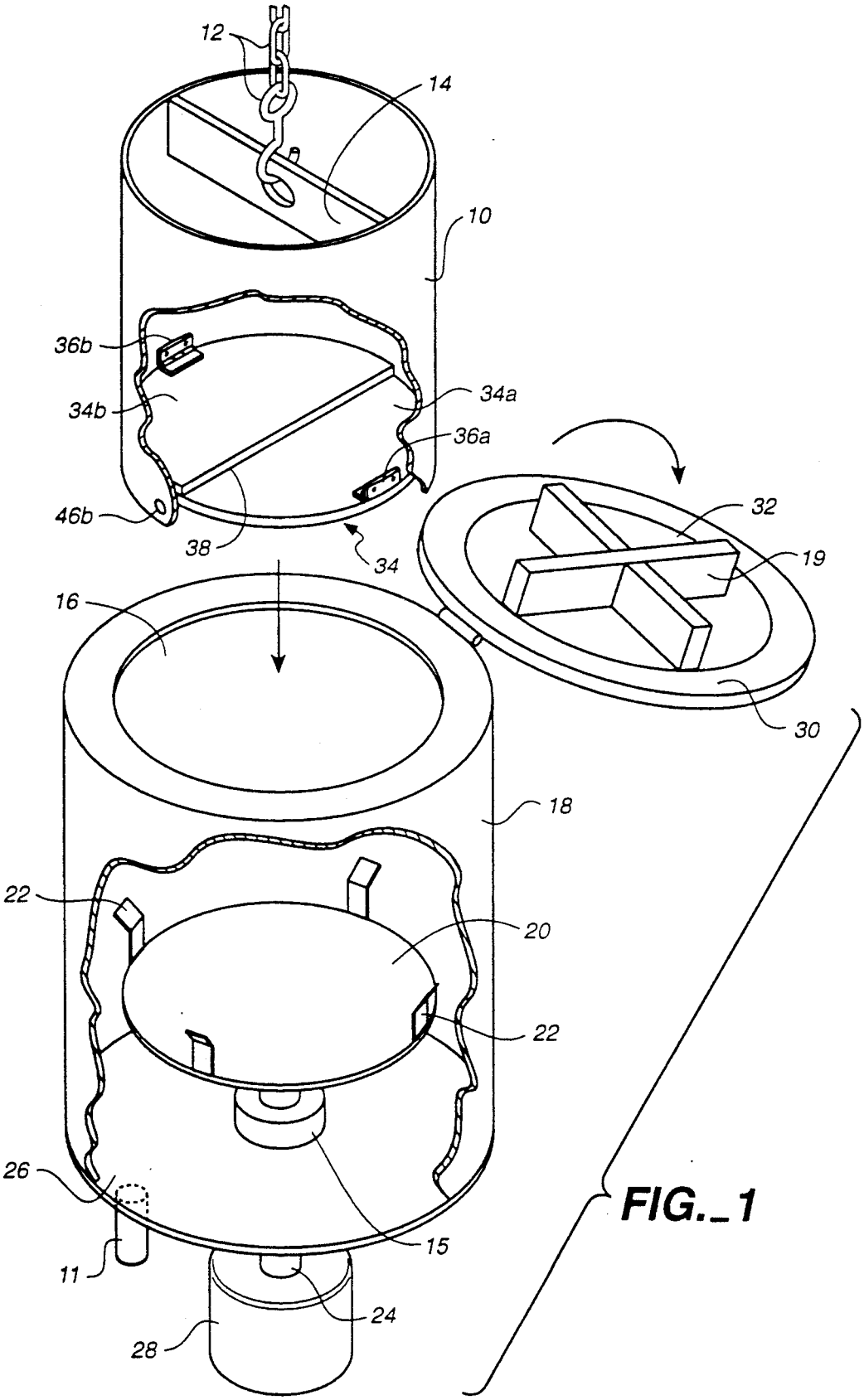
FIG. 1 shows the basket suspended above the spin-dryer tank.

Turning now to a discussion of the drawings, FIG. 1 illustrates features of the invention including a basket 10 suspended by a hoist chain 12 detachably hooked through a hole in a lift bar 14 stretched across the basket 10 near its top but recessed just below its top. The basket 10 is supported above the entrance 16 to a tank 18 cutaway to show a rotatable platform 20 at its bottom. The platform has a plurality of upstanding members 22 distributed around its perimeter that engage the bottom of the basket 10 when the basket is lowered into the tank and thereby stabilizes the basket when the basket is rotated on the rotatable platform. Each upstanding member 22 is flared in order to facilitate engagement of the basket 10 with the platform 20. The platform 20 is rotatably supported on one end of a driveshaft 24 which is journalled by a bearing 25 through the floor 26 of the tank and connected to a driving motor 28. A tank lid 30 is shown hinged to the rim of the entrance to the tank. (See tank lid hinge 31 in FIG. 2)

Figure 2:
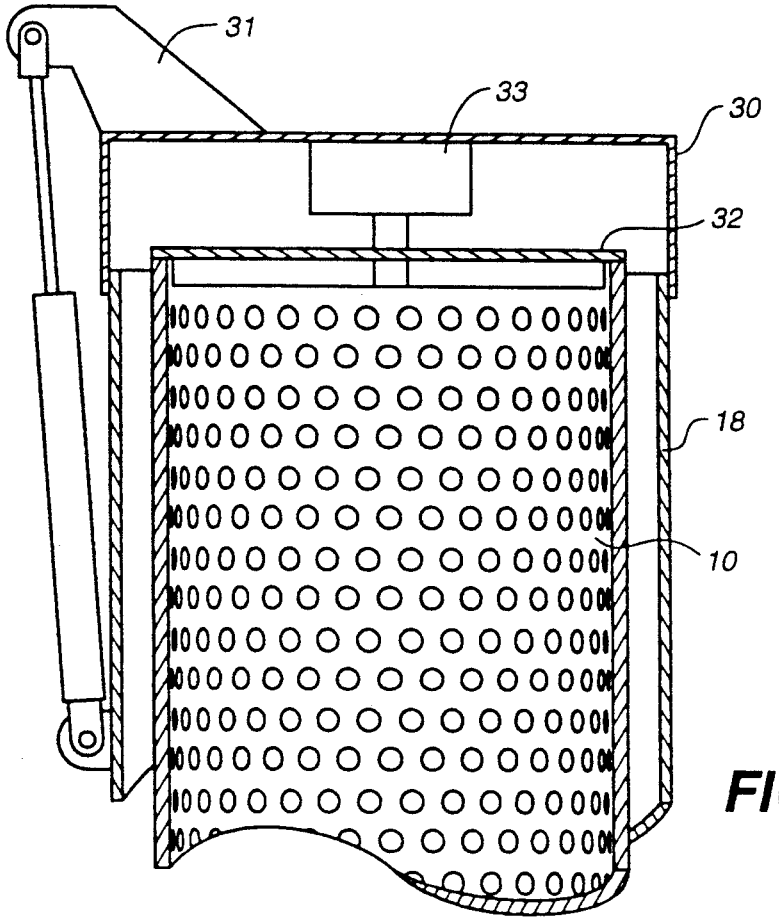
FIG. 2 is a sectional view showing the rotating lid of the basket in position on the basket.

As shown in FIG. 1 and in the sectional view of FIG. 2, a basket lid 32 is journalled by bearing 33 to the bottom side of the tank lid 30 and is positioned to engage and support the top end of the basket 10 when the lid is closed. The attachment of the basket lid 32 with struts 19 journalled to the tank lid 30 permits the basket lid 32 to rotate with the basket when it is positioned on the basket 10. The upper end of the basket 10 is thereby supported while it rotates thereby reducing any torque on the drive shaft 24 due to unbalanced distribution of the leafy product in the basket 10.

The lift bar 14 performs another important function in addition to serving as a point of attachment of the conveyor hoist. The lift bar 14 prevents interlocking or clumping of leafy product as it rotates. Experiment shows the most effective vertical width of the lift bar for this purpose ranges from three to eight inches for a bar length of thirty inches corresponding to a range of ratio of width to length between 1:10 to 3:10.

The vertical side of the basket 10 is perforated metal providing that when the basket containing leafy product is rotated about its vertical axis, any rinse water that has collected on the leafy product will be centrifugally forced out through the holes in the side of the basket 10 and drain down to the bottom of the tank 18. An outlet 11 is provided in the bottom of the tank 18 for removing the drained water from the tank.

The basket 10 may be transported to and from loading and unloading stations and positioned into and withdrawn from the tank 18 by means of a conveyor hoist (not shown) attached to the upper end of the chain 12. The basket 10 is partially cutaway in FIG. 1 to show a trapdoor floor 34*a* and 34*b* at the bottom of the basket 10. Trapdoor section 34*a* and section 34*b* are hinged at locations 36*a* and 36*b* respectively and meet along line 38 when the trapdoor 34 is closed.

Figure 3:
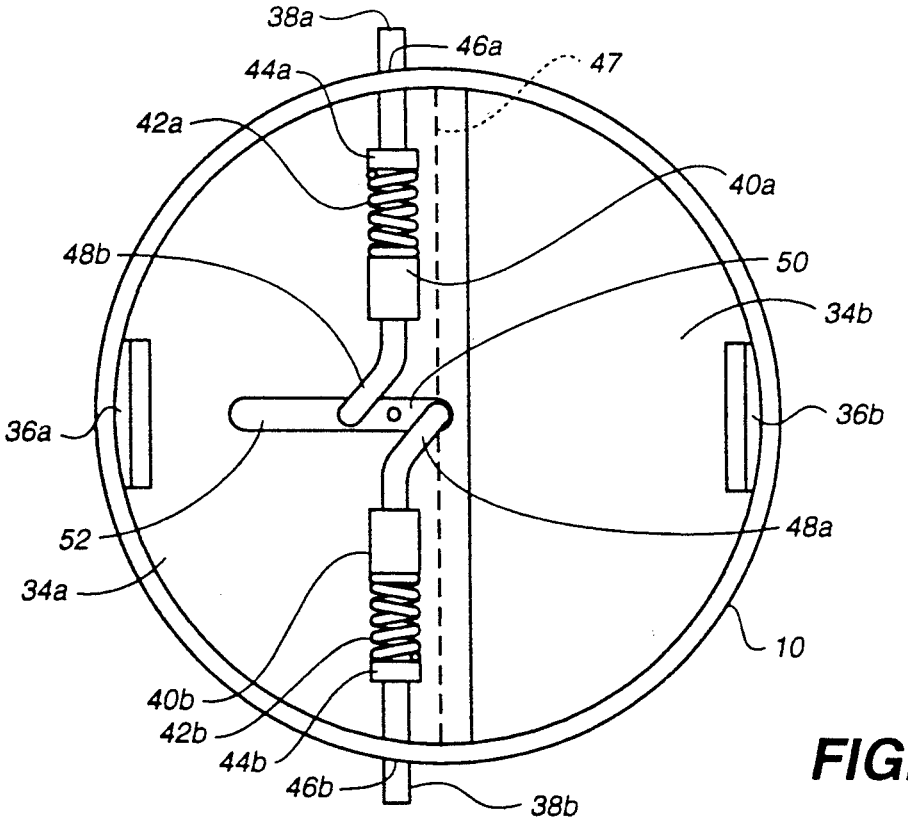
FIG. 3 is a bottom view of the basket showing details of the trap door.
Figure 4:
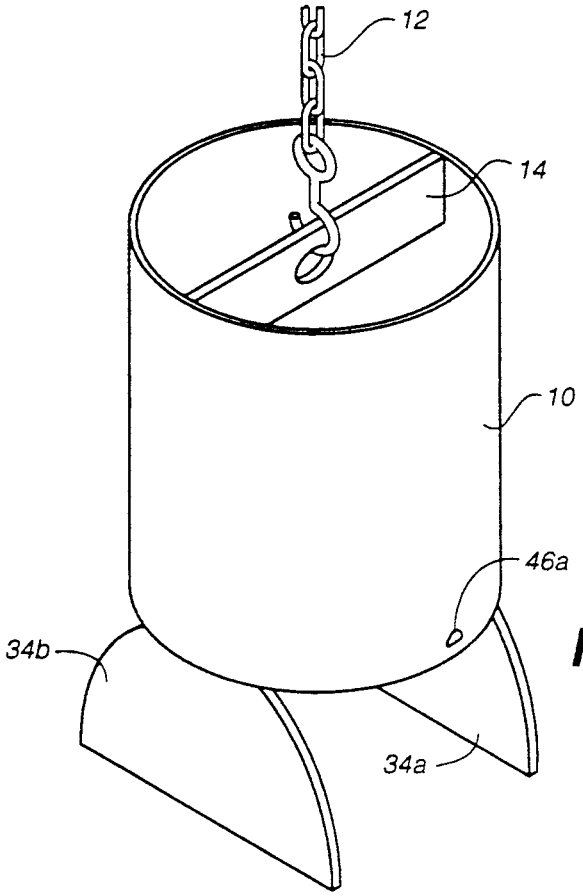
FIG. 4 shows the empty hanging basket with the trapdoor sections hanging open.

A bottom view of the basket 10 showing details of the trapdoor floor 34 is shown in FIG. 3 in the closed position. A pair of latch bars 38*a* and 38*b* are slidably retained in retainers 40*a* and 40*b* respectively secured to trapdoor section 34*a*. Shoulders 44*a* and 44*b* are formed on latch bars 38*a* and 38*b* respectively. Springs 42*a* and 42*b* mounted on latches 38*a* and 38*b* respectively are positioned between retainer 40*a* and shoulder 44*a* and between retainer 40*b* and shoulder 44*b* respectively to bias the respective latchbar to protrude through openings 46*a* and 46*b* located near the bottom of the basket 10. Trapdoor 34*b* is supported in the closed position by overlapping trapdoor section 34*a* as shown by the dashed line 47 in FIG. 3. Adjacent ends 48*a* and 48*b* of the respective latchbars are hingably attached to opposite ends of pivot bar 50 which is pivotally mounted to trapdoor section 34*a* at its center. When it is required to open the trapdoor sections 34*a* and *b*, the pivot bar 50 is rotated by grasping a handle 52 attached to pivot bar 50 thereby withdrawing the ends of the latch bars 38*a* and *b* from their respective holes 46*a* and 46*b* in the basket 10. The trapdoor sections 34*a* and *b* are thereby permitted to fall open as shown in FIG. 4 and the leafy product falls out.

In another embodiment, the handle 52 may be engaged by an elongated tool (not shown) which allows the operator to open the trapdoors with his hand safely remote from the latching mechanism.

Figure 5:
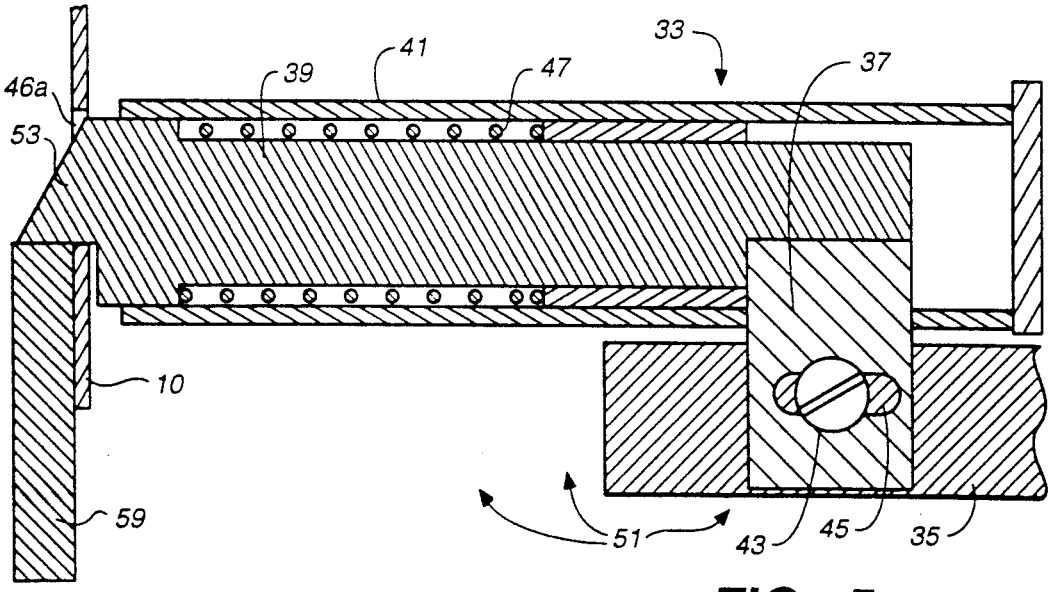
FIG. 5 shows the beveled end of the latch bar protruding through a latch hole in the basket.

FIG. 5 is a sectional view of an embodiment of ends 51 of the latchbars 38*a* and *b* in which each latchbar includes section 33 mounted onto section 35. Latchbar section 33 includes a stub 39 slidably positioned in a retaining tube 41 mounted on latchbar section 35 by bracket 37. Bracket 37 has a slot 45 through which bolt 43 bolts tube 41 to latchbar section 35. The slot 45 permits adjustment of the end 53 of stub 39 relative to a latchhole 46*a* in the basket 10. Stub 39 is biased toward the hole 46*a* by spring 47 in tube 41 so that the end 53 of the stub protrudes through the latch hole 46*a* and is supported on support member 59 when the trapdoor section 34*a* is in the closed position. Support member 59 shields the bevelled end 53 from accidental disengagement of the stub 39 during positioning of the basket 10 on the platform 20 such as may occur if stub ending 53 is accidentally lined up to contact upstanding member 22 when the basket 10 is being positioned on platform 20. The bevelled end 53 guides the stub 39 into the latch hole 46 a permitting an operator to simply slam the trapdoor sections shut after the hanging basket has been emptied thereby securing the trapdoor sections 34*a* and *b* in the closed position.

The novel construction of the spindryer of this invention permits an operator to practice a convenient and safe method of spin drying leafy produce.

In step 1, the basket attached to the chain of a hoist conveyor is filled with produce through its open top. The trapdoor sections are in the closed position.

In step 2, the basket is transported by the hoist conveyor to the tank of the spin dryer where it is lowered into the top open entrance to the tank and positioned on the rotatable platform.

In step 3, the chain hoist is disconnected from the lift bar of the basket and the lid of the tank is closed.

In step 4, the drive motor is activated and the basket with its contents is rotated thereby dislodging rinse water which collects in the bottom of the tank below the basket.

In step 5, the tank lid is opened. the chain to the conveyor hoist is reconnected to the lift bar and water is drained from the bottom of the tank.

In step 6, the basket is lifted out of the tank and conveyed to the unloading area.

In step 7, the trapdoor bottom of the basket is opened allowing the contents of the basket to fall out of the basket.

In step 8, the trapdoor is slammed shut and the basket is conveyed by the conveyor hoist back to the loading station.

In the foregoing paragraphs, an embodiment of a spindryer has been described which meets the objects of the invention. The spindryer features a basket having a trapdoor bottom and a lift bar providing that the basket may be suspended vertically by the chain of a conveyor hoist attached to the lift bar and conveniently emptied by withdrawing a latch to the trapdoor bottom. The trapdoor is then easily snapped shut. The trapdoor and liftbar arrangement eliminates the effort required to tip a heavy basket of produce as practiced with devices of the prior art. The rotatable basket lid fastened to the underside of the spindryer lid stabilizes the upper end of the basket while it is rotating so that the spindryer can accomodate a greater uneveness of distribution of the weight of product in the basket than is the case with the spindryer of the prior art. Support of the basket by a bar across its top rather than by attachments at the side of the basket is a more compact design permitting a smaller basket than the baskets of the prior art.

Other variations to the above embodiment are possible which are within the scope of the invention such as a different arrangement for securing the position of the basket on the platform. The basket may be wire mesh perforated metal or plastic.

We therefore wish the scope of our invention to be defined by the appended claims.

We claim:

1. A basket apparatus to be used in a spindryer operation for removing water from leafy product which comprises:

a cylindrical basket means having a lower end and an open upper end;

said cylindrical basket means having a vertical side with a plurality of holes;

a means at said upper end for releasably attaching said basket means to a conveyor hoist;

a trapdoor means at said lower end forming a floor of said basket means providing that said basket means containing leafy product be spun to remove rinse water then emptied by opening said trap door;

said trapdoor means comprising:

a first trapdoor section having an edge hingably attached at a first location on said vertical side proximal to said bottom end of said basket means;

a second trapdoor section having an edge supported at a second location on said vertical side;

said first and second trapdoor sections constructed in operable combination with one another to permit said first trapdoor section to secure said second trapdoor section in a closed position when said first trapdoor section is in a closed position and to permit both trapdoor sections to hand in an open position;

latch means for releasably securing said first trapdoor section in said closed position;

said latch means having two retainer means, each retainer means configured for retaining a latchbar and secured to an underside of said first trapdoor section;

two latch bars, one of each said latch bars slidably retained in one of each said retainer means having a first latch end which protrudes through one of a pair of latch holes diametrically positioned with respect to said other latch hole in said vertical side in said basket when said latch bars have been slid toward said vertical side and is withdrawn from said respective latch hole when said latch bar slides away from said vertical side;

a spring means for biasing each said at least one latch bar to protrude through said latch hole; and lever means hingably attached to a second latch end of each said at least one latch bar and pivotally attached to said underside of said first trapdoor section in operable construction to provide that, when an operator turns said lever means, said latch means is withdrawn from said latch hole permitting said first trapdoor section to fall to an open position.

2. A basket apparatus as in claim 1 which comprises;

a tank means having a bottom end and a top end with an entrance at said top end;

a horizontal platform means located adjacent to said bottom end for supporting said basket means; and means for rotating said platform means about a vertical axis providing that said basket means may be placed on said platform means and rotated to remove said rinse water.

3. A basket apparatus as in claim 2 which comprises means attached to said tank means for stabilizing said upper end of said basket means while said basket means is rotating.

4. A basket apparatus as in claim 3 wherein said tank means comprises a tank with said entrance and a tank lid hingably attached to said tank and arranged to cover said tank entrance.

5. A basket apparatus as in claim 4 wherein said stabilizing means comprises a basket lid means rotatably attached to a bottom side of said tank lid having means for engaging said basket and cover said open basket end when said tank lid is in a closed position.

6. A basket apparatus as in claim 5 wherein said basket lid means comprises a cover rotatably mounted at a central location to said bottom side of said tank lid and configured and positioned in operable combination with said open upper end of said basket means to engage said open upper end when said tank lid is in a closed position.

7. A basket apparatus as in claim 2 wherein said rotating means comprises;

a bearing means positioned on said bottom end of said tank means; and a drive shaft having one end supporting said platform means at substantially a center of said platform means and a second end extending through said bearing means and coupled to a driving motor.

8. A basket apparatus as in claim 2 wherein said platform means comprises a platform and a plurality of upstanding members at a periphery of said platform configured for receiving said bottom end of said basket means.

9. A basket apparatus as in claim 1 wherein said releasably attaching means comprises a lift bar having a width in the vertical direction and a length between two ends attached to said vertical side adjacent said upper end of said basket means and a hole through said lift bar intermediate said bar ends providing that a hook attached to a chain of said conveyor hoist be passed through said hole to suspend said basket means.

10. A basket apparatus as in claim 9 wherein said width is selected from a range of widths wherein said range consists of values between three to eight inches providing that said lift bar will disperse clumps of leafy product when said basket apparatus is spinning.

11. A basket apparatus as in claim 1 wherein said vertical side of said basket means is perforated metal.

12. A basket apparatus as in claim 1 wherein said vertical side of said basket means in wire mesh.

13. A basket apparatus as in claim 1 wherein each trapdoor section has a half circle shape with a straight edge and a half circle edge and each said half circle edge is hingably attached to a bottom end of said vertical side of said basket such that each said straight edge is substantially parallel to and adjacent to said other straight edge when said trapdoor sections are in said closed position.

14. A basket apparatus as in claim 1 wherein said latch bar end is bevelled thereby providing that said operator may move said first trapdoor section from said open position to said closed position causing said at least one latch bar to protrude into latch hole and secure said first trapdoor section in said closed position.

15. A basket apparatus as in claim 2 wherein said tank means comprises a drain means proximal to said bottom end providing that said rinse water forced from said leafy product be drained from said tank means.

16. A basket apparatus as in claim 9 wherein the ratio of said width to said length has a value falling in a range between 1:10 and 3:10.

17. A basket apparatus as in claim 1 wherein said latch means comprises:

two retainer means, each retainer means configured for slidably retaining a latchbar means and secured to an underside of said first trapdoor section;

two latchbar means, each including a latchbar section and a stub, said latchbar section retained by one of said retaining means;

a bracket means for slidably mounting each said stub on said respective latchbar section with said stub parallel to a long direction of said latchbar section; and a spring means between said bracket means and said stub for biasing each said stub to protrude through one of a pair of latch holes positioned with respect to said other latch hole in said vertical side in said basket when said latch bars have been slid toward said vertical side and is withdrawn form said respective latch hole when said latch bar slides away from said vertical side.

18. A basket apparatus as in claim 17 wherein an end of said stub protruding through said respective latch hole is bevelled thereby providing that said operator may move said trapdoor section from said open position to said closed position causing each said stub to protrude into said latch hole and secure said first trapdoor section in said closed position.

19. A method for separating leafy product from rinse water which includes the steps:

placing said leafy product in a basket having a vertical side with a plurality of holes and a lift bar at a top end of said basket;

securing said lift bar to a conveyor hoist and conveying said basket to a spindrying station;

placing said basket on a rotatable table;

separating said conveyor hoist from said lift bar;

rotating said table supporting said basket thereby forcing said rinse water through said plurality of holes;

draining away rinse water forced from said leafy product;

reattaching said conveyor hoist to said lift bar;

conveying said basket to an unloading station; and opening a multisection trapdoor in a bottom of said basket thereby permitting said leafy product to fall out of said basket and allowing all trapdoor sections to hang in an open position from said vertical side of said basket.

* * * * *